United States Patent [19]

Smit

[11] 4,031,335

[45] June 21, 1977

[54] STEREO PICK-UP WITH CASING SERVING AS COMMON POLE PIECE

[75] Inventor: Elzo Smit, Eindhoven, Netherlands

[73] Assignee: U.S. Philips Corporation, New York, N.Y.

[22] Filed: Mar. 19, 1975

[21] Appl. No.: 559,736

[30] Foreign Application Priority Data

Apr. 1, 1974 Netherlands ..... 7404359

[52] U.S. Cl. ..... 179/100.41 K; 179/100.41 M; 179/100.41 Z

[51] Int. Cl.[2] ..... H04R 11/12

[58] Field of Search ..... 179/100.41 Z, 100.41 K, 179/100.41 M, 100.41 D, 100.41 R

[56] References Cited

UNITED STATES PATENTS

| | | | |
|---|---|---|---|
| 3,043,920 | 7/1962 | McConnell | 179/100.41 M |
| 3,055,988 | 9/1962 | Bauer | 179/100.41 M |
| 3,230,318 | 1/1966 | Engel | 179/100.41 K |
| 3,294,405 | 12/1966 | Pritchard | 179/100.41 K |
| 3,299,219 | 1/1967 | Madsen | 179/100.41 K |
| 3,441,688 | 4/1969 | Shaper | 179/100.41 K |
| 3,646,279 | 2/1972 | Stanton | 179/100.41 K |
| 3,761,647 | 9/1973 | Nemoto | 179/100.41 K |

*Primary Examiner*—Bernard Konick
*Assistant Examiner*—Alan Faber
*Attorney, Agent, or Firm*—Frank R. Trifari; David R. Treacy

[57] ABSTRACT

A transducer for scanning or cutting disc-shaped record carriers, in which a movable element is omnidirectionally pivotable, one polepiece being provided for each of the two directions of oscillation. A third polepiece provided in common for the two directions of oscillation is formed by the casing of the transducer.

11 Claims, 10 Drawing Figures

STEREO PICK-UP WITH CASING SERVING AS COMMON POLE PIECE

Figure 1A:
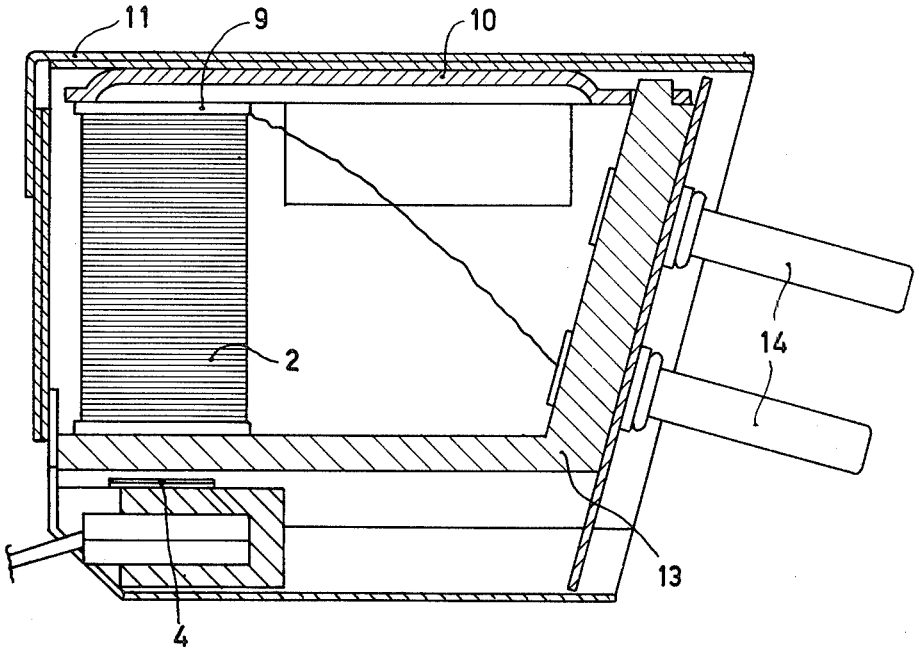

The invention relates to a pick-up and/or cutter for scanning and/or cutting information in a track groove of a disc-shaped record carrier, hereinafter referred to as a track groove transducer. Such a transducer comprises a stylus holder, which at one end is provided with a stylus and at its other end has a movable element which is pivotable in all directions and which cooperates with two polepieces, one for each of two mutually perpendicular oscillating directions, while a third polepiece is provided which co-operates with each of the two other polepieces.

Such an arrangement is known from U.S. Pat. No. 3,646,279 which issued Feb. 29, 1972 to W. O. Stanton, in which arrangement poles are induced in the movable element by a permanent magnet which is fixed in the mounting block, the assembly being accommodated in a casing of a soft-magnet material, that is, one having low remanence.

According to one feature of the invention the third polepieces forms part of a casing of a softmagnet material to which the two other polepieces are connected. The configuration provides the surprising advantage that the transducer becomes less susceptible to extraneous interference voltages. Further, the construction can be simplified.

In a preferred embodiment of a transducer according to the invention a coil is disposed on the connecting piece between the pole portion of each of the two polepieces which co-operates with the movable element and the casing, while the movable element consists of a soft-magnetic material.

In a further preferred embodiment according to the invention the movable element consists of a permanent magnet. Thus, a transducer of the magneto-electric type is obtained.

In a different embodiment each of the magnetic circuits formed by the two polepieces and the casing includes a permanent magnet and the movable element is soft-magnetic. This is consequently a track groove transducer of the electro-magnetic type.

In yet another embodiment according to the invention each of the magnetic circuits formed by the two polepieces and the casing includes a magnetically sensitive element. Such an element may for example consist of a Hall element, a magneto-resistor or a magnetodiode.

It is clear that the third polepiece may be V-shaped, the legs of the V making an angle of substantially 90° opposite the two polepieces; but in still a further embodiment of a transducer according to the invention the casing portion which constitutes the third polepieces is substantially flat. This further simplifies the casing, while the sensitivity and the separation of the two channels are not affected thereby.

In still another embodiment the two polepieces are strip-shaped and bent in such a way at the location of the movable element that the two legs are in parallel and are each provided with a coil, said coils at the end of the polepiece which faces away from the movable element each surrounding a U-shaped magnetic yoke which is connected to the casing.

A particularly advantageous embodiment of a transducer according to the invention is obtained by shaping the two polepieces as round rods, which may be permanent magnets, which rods extend substantially in the direction of the axis of the movable element and at their sides which face away from the movable element are connected to the casing. This allows the use of cylindrical coils, which can have a better winding factor, so that in the same volume more turns can be accommodated than on a rectangular coil. Moreover, the average distance from the turns to the casing is greater, so that smaller magnetic coupling with the casing is obtained. Furthermore, the distance to the third polepiece is greater for round polepieces with the same maximum dimension as the flat polepieces, so that again the hum voltage is reduced, while the mutual distance between polepieces is also greater, this separation having a favorable influence on the separation of the two channels. Further, manufacture of the polepieces is simpler and the occurrence of faults during assembly of the polepieces is less likely. In addition, the mutual equality of the channels is more closely approximated.

In yet a different embodiment the round rods are U-shaped, one leg of the U cooperating with the movable element, and the coil being disposed around the other leg which may be longer than the coil, the ends of said other legs being connected to each other and to the casing by means of a magnetic material. This enables the length of the pick-up and/or cutter to be reduced.

In still a further embodiment according to the invention the round rods are Z-shaped, while one end leg of the Z co-operates with the movable element and the coil is disposed at the other leg, which may be longer, the end of the lastmentioned leg being connected to the casing. The advantage of this is that the magnetic leakage of the flux which is not coupled with the coils to the casing is reduced and the output voltage is consequently increased.

Figure 2A:
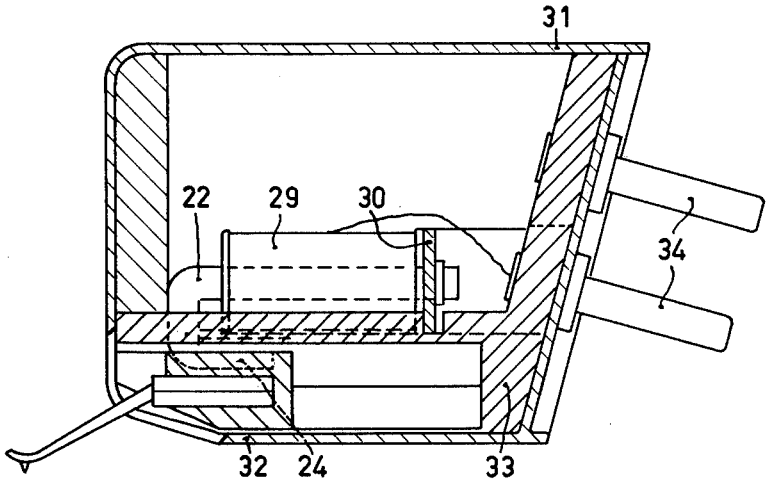
Figure 2B:
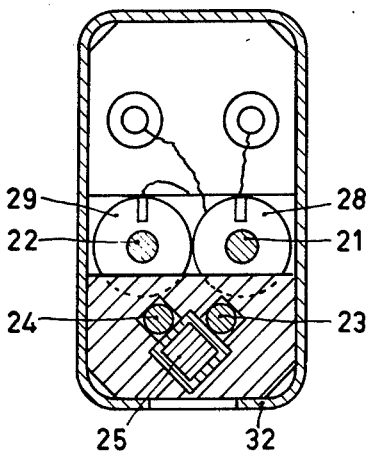
Figures 3, 3A:
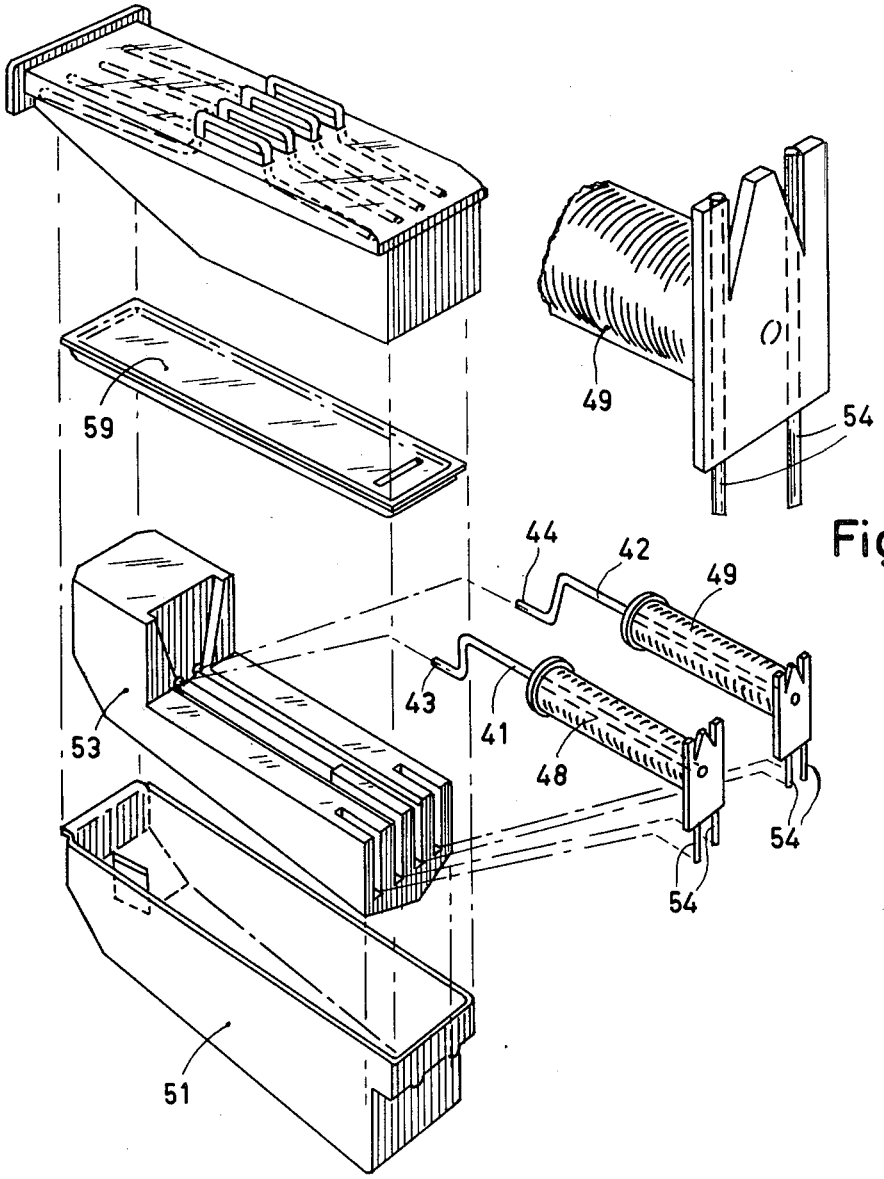

The invention will be described in more detail with reference to the following Figures, in which FIG. 1, consisting of 1*a* and 1*b*, shows a pick-up and/or cutter with two flat polepieces and a V-shaped third polepiece, and FIG. 2, consisting of 2*a* and 2*b* shows a pick-up and/or cutter with two round U-shaped polepieces and flat third polepiece, FIG. 3 shows a pick-up and/or cutter with two Z-shaped polepieces and a substantially flat third polepiece, FIG. 3*a* being an enlarged fragmentary view of a coil rear flange, and FIG. 4 show alternative embodiments of a stylus unit, consisting of 4*a* through 4*d*, The pick-up in FIG. 1 consists of two polepieces 1 and 2, which are formed from a strip-shaped material and whose end pole portions 3 and 4 extend in the longitudinal direction of the movable element 5. Said polepieces are bent, the ends or connecting pieces which do not co-operate with the magnetic element being parallel and each being surrounded by coils 8 and 9 respectively. At the top of the coils 8 and 9 a U-shaped magnetic yoke 10 is disposed which connects the two polepieces and which is slightly embossed at the location of the base of the U and thus makes contact with the casing 11 whose lower side constitutes the V-shaped third polepiece. The assembly is mounted in a plastic block 13 in which the connection terminals are also fixed.

Figure 1B:
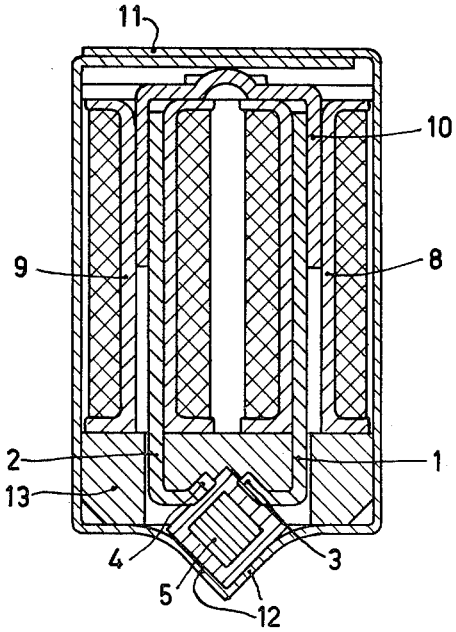

FIG. 2 shows a transducer whose polepieces consist of U-shaped round rods 21 and 22 respectively, while one pole portion or leg of the U 23 and 24 respectively co-operates with the movable element 25 which, like the element 5 of FIG. 1, is pivotable to all sides and secured to one end of a stylus holder at whose other end a stylus is disposed; and on the other leg coils 28 and 29 are disposed respectively, which coils 28 and 29 in this embodiment have the form of cylindrical coils. The ends which co-operate with the movable element are simply slid into recesses in a plastic block 33, while the coils 28 and 29 engage a slot in the plastics block 33, the ends of the legs of the U-shaped round rods 21 and 22 respectively which do not cooperate with the movable element 25 being connected by a U-shaped yoke 30 of a magnetic material whose legs are connected to a casing 31. The bottom 32 of the casing 31 which consists of a soft-magnet material constitutes the third polepiece and is flat in the present instance. The connection terminals 34 are mounted in the plastic block 33.

The movable elements 5 and 25 respectively in the two embodiments described above take the form of permanent magnets, but it is alternatively possible to manufacture these elements from a soft-magnet material and to dispose a permanent magnet between the yoke 8 and the casing 11 or to make the yoke 30 of a permanent-magnet material.

FIG. 3 shows a modification of the track groove transducer of FIG. 2, the rod-shaped polepieces 41 and 42 being z-shaped. As the pieces of the polepieces (41 and 42) which connect the legs of the Z are spaced further away from the casing 51 than the portion of the polepieces 21 and 22 of FIG. 2 which connect the legs of the U, there is less magnetic leakage to the casing 51.

The polepieces 41 and 42 are slid into recesses of a plastic block 53, after which the coils 48 and 49 respectively in their turn are slid onto the other leg of the polepieces 41 and 42 respectively. The rear flange of each of the coils 48 and 49 is rectangular and is retained by the plastic block 33 and the cover 59 of the casing 51, the connection wires 54 in the rear flanges of the coils 48 and 49 being accessible from outside.

FIG. 4 shows a number of embodiments of a stylus unit usable with the above described transducers.

Figure 4A:
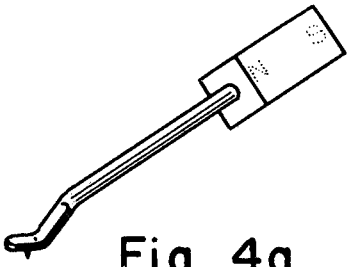

FIG. 4*a* shows a movable element which extends as a rod substantially in the longitudinal direction of the stylus holder and which can both be permanent-magnetic, the poles being preferably located at the ends as is shown in the drawing by way of example, and soft-magnetic, while the cross-section may be square or round.

Figure 4B:
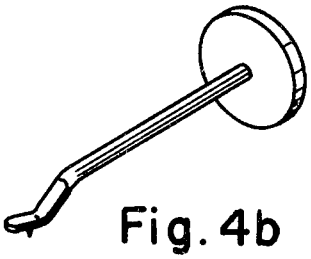
Figure 4C:
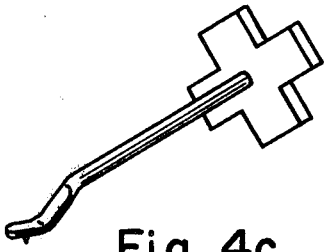

It is alternatively possible to make the movable element disc-shaped or cross-shaped, as is shown in FIGS. 4*b* and *c*.

Figure 4D:
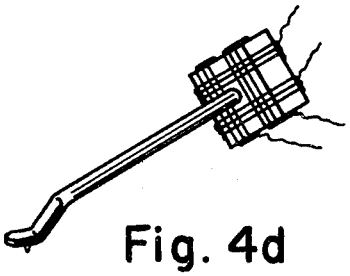

FIG. 4*d* shows an embodiment of the electrodyanmic type, in which the movable element has two coils whose axes are perpendicular to each other.

In an embodiment of an electromagnetic or electrodynamic pick-up and/or cutter one or more permanent magnets may be disposed in the stationary portion in FIGS. 1, 2 and 3, i.e. in the embodiment of FIGS. 1 and 2 between the yoke 10 and 30 respectively and the casing 11 and 31 respectively, in FIG. 3 between the polepieces 41 and 42 respectively and the casing 51, or the polepieces themselves may take the form of longitudinally magnetized permanent magnets.

For transducers with a magneto-sensitive element such as a Hall element, a magneto-resistor or a magneto-diode, said elements, i.e. one for each oscillating direction, may be disposed between the polepieces and the casing. It should be clear that, when providing pick-ups and/or cutters of the last-mentioned type and of the electro-dynamic type the coils on the polepieces may be dispensed with.

Although in the embodiments described in detail, the movable element is disposed between the faces of the polepieces which extend in the longitudinal direction of the movable element and the casing, alternative arrangements are possible, for example an arrangement in which the movable element is interposed between the end faces of the polepieces and the casing.

The movable element may be accommodated in a readily exchangeable stylus unit, which can be slid into the space between the poles.

What is claimed is:

1. A track groove transducer of the type having a stylus holder and two polepieces arranged for magnetic sensing of stylus holder oscillatory pivoting in each of two mutually perpendicular directions, and a third polepiece cooperating magnetically with said two polepieces, wherein said transducer comprises a magnetically shielding casing made of soft magnetic material, a portion of said casing forming said third polepiece.

2. A transducer as claimed in claim 1 wherein said stylus holder comprises a movable element made of magnetic material, said two polepieces each comprise a pole portion and a connecting piece for magnetic connection between said pole portion and the casing, said movable element being disposed between said pole portions and said third polepiece; and said transducer comprises two coils each arranged on a respective connecting piece.

3. A transducer as claimed in claim 2, wherein said movable element comprises a permanent magnet.

4. A transducer as claimed in claim 3 wherein said portion of said casing forming said third polepiece is V-shaped.

5. A transducer as claimed in claim 1, wherein said stylus holder comprises a movable element made of soft magnetic material, a magnetic circuit formed by the casing, the third polepiece, piece, and respective ones of said two polepieces including a magnetically sensitive element.

6. A transducer as claimed in claim 1, wherein said portion of said casing forming said third polepiece is a portion of a flat surface.

7. A transducer as claimed in claim 1, comprising a magnetically shielding casing made of soft magnetic material, a U-shaped magnetic yoke connected to the casing, and two coils arranged on respective legs of said U-shaped yoke, each of said two pole pieces having a strip-shaped portion inserted in a respective one of said coils and overlapping a respective leg of the yoke.

8. A transducer as claimed in claim 1, comprising a magnetically shielding casing made of soft magnetic material; and wherein said stylus holder has a longitudinal axis and a movable element made of magnetizable material and extending transversely of said axis, and each of said two polepieces is a round rod of permanently magnetic material having an end forming a pole portion opposite said movable element and extending substantially parallel to said axis, and another end connected to said casing.

9. A transducer as claimed in claim 8, comprising two coils, wherein each rod is U-shaped, one leg of the U being said end forming a pole portion, the other leg of the U being longer than said one leg, a respective one of said coils disposed about each of said other legs, said another end being connected to each other and to the casing by the magnetic material.

10. A transducer as claimed in claim 8 comprising two coils, wherein each rod is Z-shaped, one end leg of the Z being said end forming a pole portion, the other leg of the Z being longer than said one leg, a respective one of said coils disposed about each of said other legs, said another end being a distal end of said other leg and being connected to the casing by a magnetic material.

11. A track groove transducer of the type having a stylus holder and two polepieces arranged for sensing of stylus holder oscillatory pivoting in each of two mutually perpendicular directions, and a third polepiece cooperating magnetically with said two polepieces, wherein said transducer comprises a magnetically shielding casing made of soft magnetic material, a portion of said casing forming said third polepiece, and said stylus holder comprises a movable element having two coils having axes perpendicular to each other.

* * * * *